United States Patent [19]

Hersey et al.

[11] 3,982,756

[45] Sept. 28, 1976

[54] SIT-N-CYCLE

[76] Inventors: Carl Hersey, 4333–49th Ave., South St. Petersburg, Fla. 33711; W. Paul Resop, 8041 Blind Pass Road, St. Petersburg Beach, Fla. 33706

[22] Filed: Apr. 28, 1975

[21] Appl. No.: 572,678

[52] U.S. Cl. ..... 272/126; 272/134; 272/DIG. 4; 272/132

[51] Int. Cl.[2] ..... A63B 21/00

[58] Field of Search ..... 272/79 R, 79 D, DIG. 3, 272/DIG. 4, 80, 58, 126, 134

[56] References Cited

UNITED STATES PATENTS

| | | | |
|---|---|---|---|
| 2,832,595 | 4/1958 | Hastings | 272/126 X |
| 3,606,321 | 9/1971 | Macoulis | 272/82 X |
| 3,618,942 | 11/1971 | Bates | 272/83 X |
| 3,802,701 | 4/1974 | Good | 272/79 R |
| 3,843,119 | 10/1974 | Davis | 272/79 R |

FOREIGN PATENTS OR APPLICATIONS

| | | | |
|---|---|---|---|
| 213,362 | 10/1966 | Sweden | 272/80 |

*Primary Examiner*—Richard C. Pinkham
*Assistant Examiner*—William R. Browne

[57] ABSTRACT

An exercising device made up of a handle and a staff fixed to the handle and extending perpendicular thereto. A first eye having an elongated threaded part fixed to it extending through a hole in the staff adjacent to handle. A second eye is interlinked with the first eye and has an elongated end passing through the intermediate part of a U-shaped pulley receiving member and a nylon member in the U-shaped member, the cord passes around a pulley in the u-shape member and terminates at each end in a loop. Each loop has a plate-like member supported in it by means of a notch at each end that receives the cord forming the loop. A yoke is positioned on the side of the U-shaped pulley receiving member that threadably receives a member which engages the wheel when the latter is rotating.

1 Claim, 5 Drawing Figures

SIT-N-CYCLE

GENERAL STATEMENT OF INVENTION

The exercising device disclosed herein is shown made up of metalic tubing of a type familiary to those skilled in the art. The short piece of tubing forming the handle passes through a hole in the long tube adjacent one end of the long tube and bicycle-like hand grips are supported on each end of the handle. A first eye has an elongated threaded part which passes through a hole adjacent to the handle and has a nut clamping it to the elongated member. A second eye interlinks with the first eye and has an elongated part that passes through the intermediate part of a pulley and it can have a Nylon block fixed to the U-shaped part of the pulley providing a pivot member for the second eye. The pulley has an outside groove and because of the way the two eyelets are interlinked, the pulley will take a position providing the least amount of friction either extending in a plane parallel to the elongated member or when the pulley is placed adjacent, the user, the pulley will dangle downward. The operator may sit on a chair and hold one end of the handle in each hand and insert one foot in each of the loops and move his feet up and down in a manner like riding a bicycle.

REFERENCE TO PRIOR ART

The disclosure herein constitutes an improvement over the exercising device shown in U.S. Pat. No. 2,832,595, but also contains several improvements over the exercising device shown in this Patent, particularly with regard to the matter of mounting the pulley, which makes it possible for the pulley to be supported completely away from and spaced from the vertical member of the exercising device.

OBJECTS OF THE INVENTION

It is an object of the invention to provide an improved exercising device.

Another object of the invention is to provide an exercising device that is simple in construction, economical to manufacture and simple and effecient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF DRAWINGS

DETAILED DESCRIPTION OF THE DRAWINGS

Figure 1:
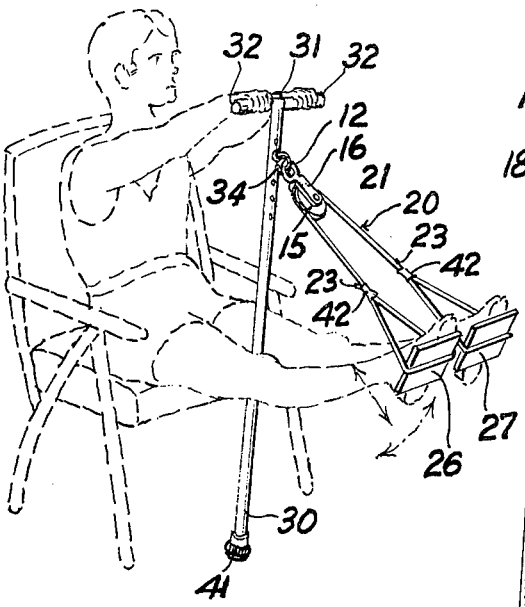
FIG. 1 is an isometric view of the exercising device according to the invention.
Figure 2:
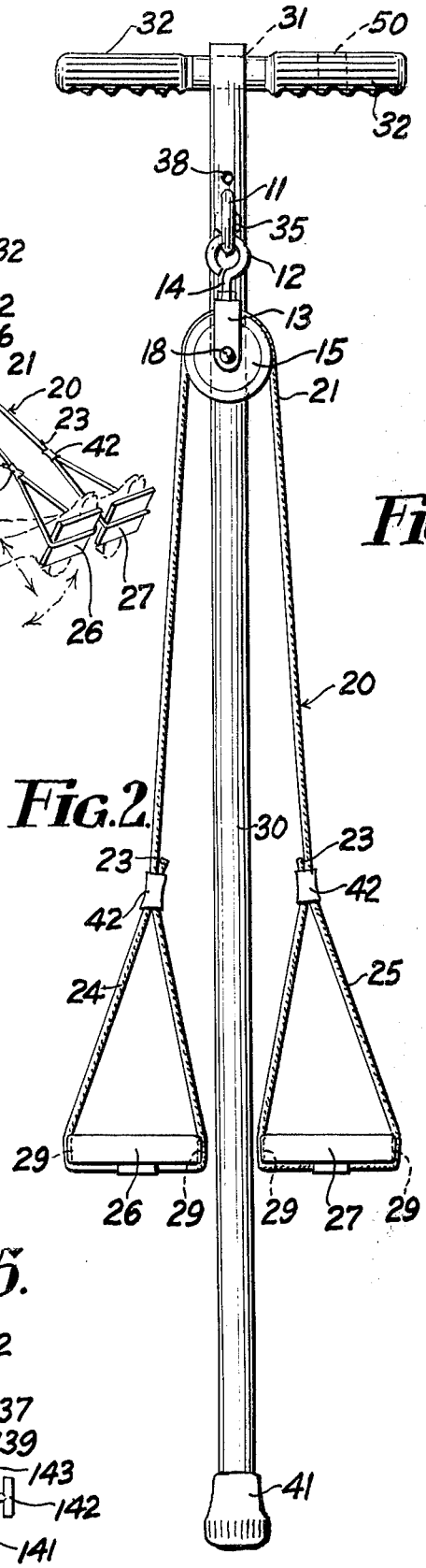
FIG. 2 is a front view of the exercising device.

Now with particular reference to the drawing, the invention disclosed herein is made up of a handle 10, which may be made of a metalic tube or the like and a staff 30. The staff has an opening 31 in is through which the handle passes. The handle has a bicycle hand grip member 32 received on each edge. The bicycle handle grips have several grooves in the lower sides thereof to receive the fingers of the user.

A first eye 11, has an elongated part 34 that is threaded and passed through a hole in the staff adjacent the end having the handle and two spaced nuts 35 threadably received on the elongated member. The second eye 12, is interlinked with the first eye. The second eye has an elongated member that passes through the intermediate part 14 of the U-shaped member 13. The intermediate part of the U-shaped member is attached to the second eye of a Nylon block 37 which is supported between the legs of the U-shaped member and the elongated member of the second eye has a head 39 that is received in the counter-sunk opening 40 in the block member so that the elongated part of the second eye can pivot in the Nylon block 37.

It will be noted that the first eye member could be fixed to the handle of the intermediate part and the staff could be deleted, thereby providing an exercising device which a person can use while lying on his back on the floor.

The embodiment of the invention in FIG. 1 hereof can best be used by supporting the staff 30 so that the pulley is on the side remote from the user and with the user sitting in a chair having the staff inclined upwardly from the floor at an angle of approximately 30°. The user can then pedal the pedals up and down in the manner of the pedals of a bicycle.

The U-shaped member 13 has spaced legs 16 and 17. The wheel 15 is received between the spaced legs. The wheel 15 has a peripheral groove 19 and a central opening through which the axle 18 passes. A cord 20 passes around the pulley wheel 15 and is received in the groove 19. The cord 20 has a bit portion 21 that passes around the pulley and two ends 22 and 23. The ends 22 and 23 are looped back on themselves and are fastened by cable clamps 42 forming loops 24 and 25. Each loop 24 and 25 receives one of the flat plate-like members 26 or 27 and each plate-like member has a notch 29 in each end of it and the ropes forming the loops 24 and 25 are received in notches 29, thereby holding the plate-like members in position.

The staff has a crutch tip 41 on the floor end which may be made of rubber or a similar anti-skid material and the ends of the handle 10 each have a bicycle hand-grip on them which may be grasped by the hand of the user without worry about slipping. A suitable cup 43 is received on the upper end of the staff 30 to prevent it from injuring the user and a piece of adhesive tape 45 is wrapped around each end of each of the handles to provide a frictional surface and prevent the accidental removal of the grip members 46 and 47. Staff 30 may have adjustable holes 38 so that the device may be adjusted to a desired height.

Figure 3:
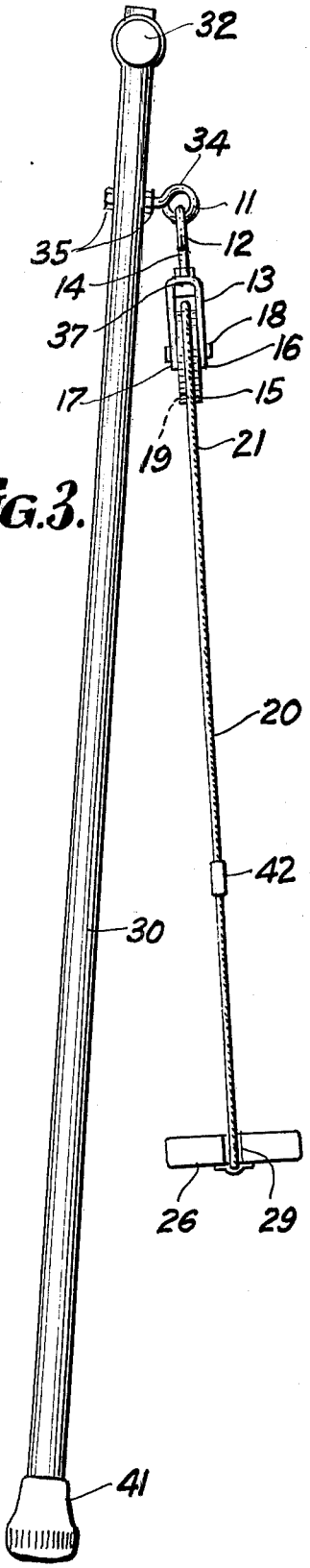
FIG. 3 is a side view of the exercising device.
Figure 4:
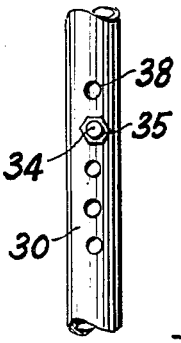
FIG. 4 is an enlarged partial front view of the exercising device.
Figure 5:
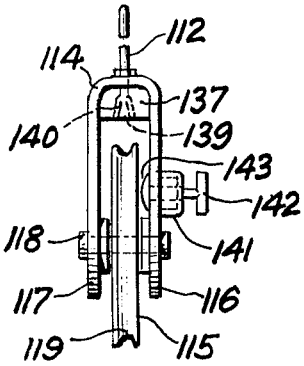
FIG. 5 is a partial front view of another embodiment of the invention.

In the embodiment of the invention shown in FIG. 5, a second embodiment of the invention is shown wherein a wheel 115 similar to the wheel 15 in FIG. 3, is supported in a U-shaped member 113, the U-shaped member has an intermediate part 114 and spaced legs 116 and 117 which receive the wheel 115 therebetween. The wheel has an outer peripherial groove 119 for receiving a rope. The Nylon block 137 is received between the legs of the U-shaped member and the nylon block has a counter sunk hole 140 which receives the head 139 of the elongated member 112 on the second eye. The yoke 141 is fixed to the leg 116 and a headed screw 142 threadably engages the yoke 141 and has a nylon head 143 on its inner end. By adjusting the headed screw 142 inward, the nylon head 143 can be brought into engagement with the wheel thereby acting as a brake.

To use the device, the user may sit in a chair and extend the staff 30 toward the chair so that he can conveniently insert his feet in the loops 24 and 25, he can then bring the staff 30 to a near vertical position or inclined toward himself as best suits his taste. He may then pump his feet up and down for exercise, much like riding a bicycle. The hand grips 32 prevent the operators hands from slipping off the handles and crutch tip 41 prevents the staff from slipping to the floor. A piece of adhesive tape, indicated at 50, is wrapped around the handlebar to hold the hand grips in place and to prevent the hand grips from slipping from the handles.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An exercising device comprising, a staff made of rigid elongated material and a handle fixed to said staff, a first eye fixed to said staff member and extending therefrom, a second eye interlinked with the first eye, the second eye interconnected with said first eye having an elongated portion attached to a U-shaped member, the U-shaped member having an intermediate part and spaced legs, a wheel having an outer peripheral groove received between said legs, an axle passing through said wheel and said legs, a cord having a bite portion passing around said wheel, two end portions, said end portions of said cord being folded back on themselves and attached thereto forming loops, foot rest members supported in said loops, said first eye member fixed to said staff member adjacent said handle and said first eye member has an elongated threaded part passing through a hole in said staff member and a nut on each side of staff member clamping said first eye member to said staff, said U-shaped member has a nylon member received therein and said second eye member passes through said nylon member and has a head thereon received in a counter bore in said eye member, whereby said U-shaped member is swiveled to said second eye member, a yoke is supported on the side of said U-shaped member, a threaded member threadably engages said yoke and extends through said U-shaped member to produce a drag on the wheel when the wheel is rotating.

* * * * *